US005085575A

United States Patent [19]

Keller et al.

[11] Patent Number: 5,085,575

[45] Date of Patent: Feb. 4, 1992

[54] METHOD FOR PREMIXED COMBUSTION OF A LIQUID FUEL

[75] Inventors: Jakob Keller, Dottikon; Jürgen Haumann, Klingnau, both of Switzerland

[73] Assignee: ASEA Brown Boveri, Baden, Switzerland

[21] Appl. No.: 630,239

[22] Filed: Dec. 19, 1990

[30] Foreign Application Priority Data

Dec. 19, 1989 [CH] Switzerland ..... 4543/89

[51] Int. Cl.[5] ..... F23C 5/00

[52] U.S. Cl. ..... 431/8; 431/173; 431/284; 431/354

[58] Field of Search ..... 431/2, 8, 9, 116, 173, 431/284, 182, 285, 354, 351; 60/737, 748; 239/290, 399, 403

[56] References Cited

U.S. PATENT DOCUMENTS

| | | | |
|---|---|---|---|
| 3,890,088 | 6/1975 | Ferri | 431/351 |
| 3,980,422 | 9/1976 | Dennis | 431/116 |
| 4,003,691 | 1/1977 | Wormser | 431/116 |
| 4,932,861 | 6/1990 | Keller et al. | 431/8 |

FOREIGN PATENT DOCUMENTS

| | | |
|---|---|---|
| 0095788 | 12/1983 | European Pat. Off. . |
| 0321809 | 6/1989 | European Pat. Off. . |
| 2018485 | 1/1971 | Fed. Rep. of Germany . |

OTHER PUBLICATIONS

Patent Abstracts of Japan, vol. 9, No. 272 (M-425) (1995), Oct. 30, 1985, & JP-A-60-117008, Jun. 24, 1985, M. Sasaki, "Burner".

*Primary Examiner*—James C. Yeung

*Attorney, Agent, or Firm*—Oblon, Spivak, McClelland, Maier & Neustadt

[57] ABSTRACT

In a premixed type of combustion of a liquid fuel at high pressure, the injection of the fuel (4*c*, 4*d*) and its evaporation with a gaseous medium (5) is undertaken, in order to prevent premature ignition of the liquid/gaseous mixture in the burner itself, at a location where the droplets of the fuel from the fuel nozzles (4*a*, 4*b*) are screened from the flame radiation from the flame front of the burner. As soon as the fuel (4*c*, 4*d*) is pre-evaporated, i.e. leaves the duct (7*a*, 7*b*) via the inlet slot (1*d*, 2*d*) in the direction of the internal space (3) of the burner as a mixture (6), it absorbs practically no flame radiation.

4 Claims, 2 Drawing Sheets

METHOD FOR PREMIXED COMBUSTION OF A LIQUID FUEL

BACKGROUND OF THE INVENTION

1. Field of the Invention

The present invention concerns a method for premixed combustion. It also concerns a burner for carrying out the method.

2. Discussion of Background

A burner is known from EP-A1-0321 809 in whose internal space is placed a fuel nozzle from which a cone-shaped column of fuel forms spreading cut in the flow direction, the column being mixed by a rotating combustion airflow flowing tangentially into the burner, which consists of two hollow partial conical bodies positioned one upon the other with increasing conical opening in the flow direction and with centrelines offset relative to one another. The ignition of the air/fuel mixture takes place at the outlet from the burner, a "reverse flow zone", which prevents flashback of the flame from the combustion space into the burner, forming in the region of the burner mouth.

If diesel oil is used as fuel in a combustion chamber with a high pressure ratio, it has been found that it can ignite, at high pressure ratios, immediately after mixture formation in the burner. For this reason, premixed operation at high pressure ratios cannot always be achieved in the case of liquid fuel. The reason for the great differences in terms of ignition delay period is associated with the flame radiation At high pressures, the flame radiation ($H_2O$, CO) will be very high; a substantial part of the radiation is absorbed by the fuel droplets (opaque mist). This energy transfer mechanism to the liquid fuel leads to a drastic reduction in the ignition delay period.

SUMMARY OF THE INVENTION

Accordingly, one object of the invention, is to prevent, in a method of the type mentioned at the beginning, the interaction between flame radiation and fuel droplets which leads to premature ignition of the mixture.

The essential advantage of the invention may be seen in the fact that the injection and evaporation of the fuel is screened from the flame radiation in such a way that the fuel only enters the radiation region of the flame after its evaporation. Because an evaporated fuel absorbs practically no flame radiation, the danger of premature ignition of the mixture is therefore removed.

Advantageous and desirable extensions of the method of achieving the object in accordance with the invention are given in the further dependent claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
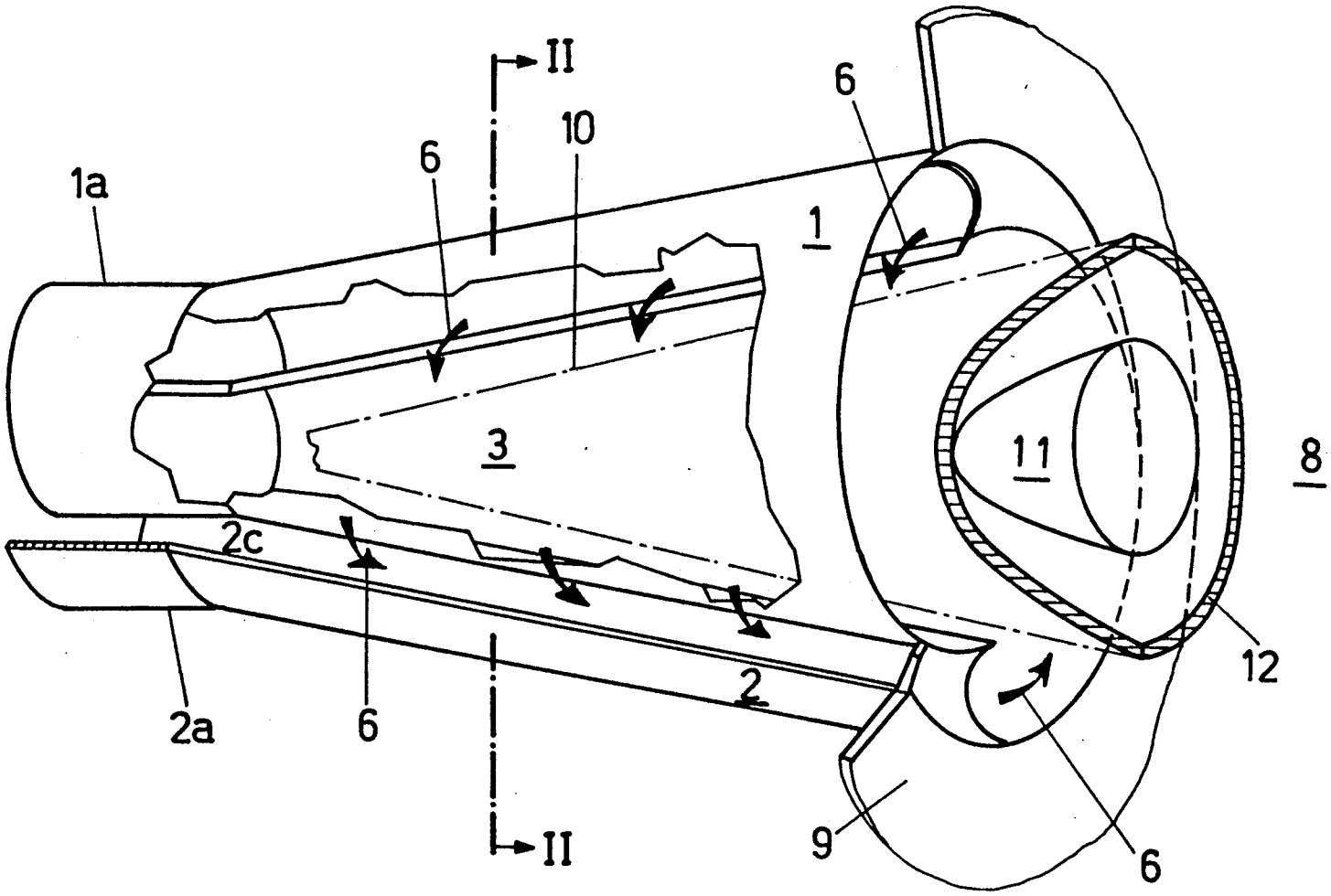
FIG. 1 shows a perspective representation of the burner body, appropriately sectioned, with the tangential air supply indicated
Figure 2:
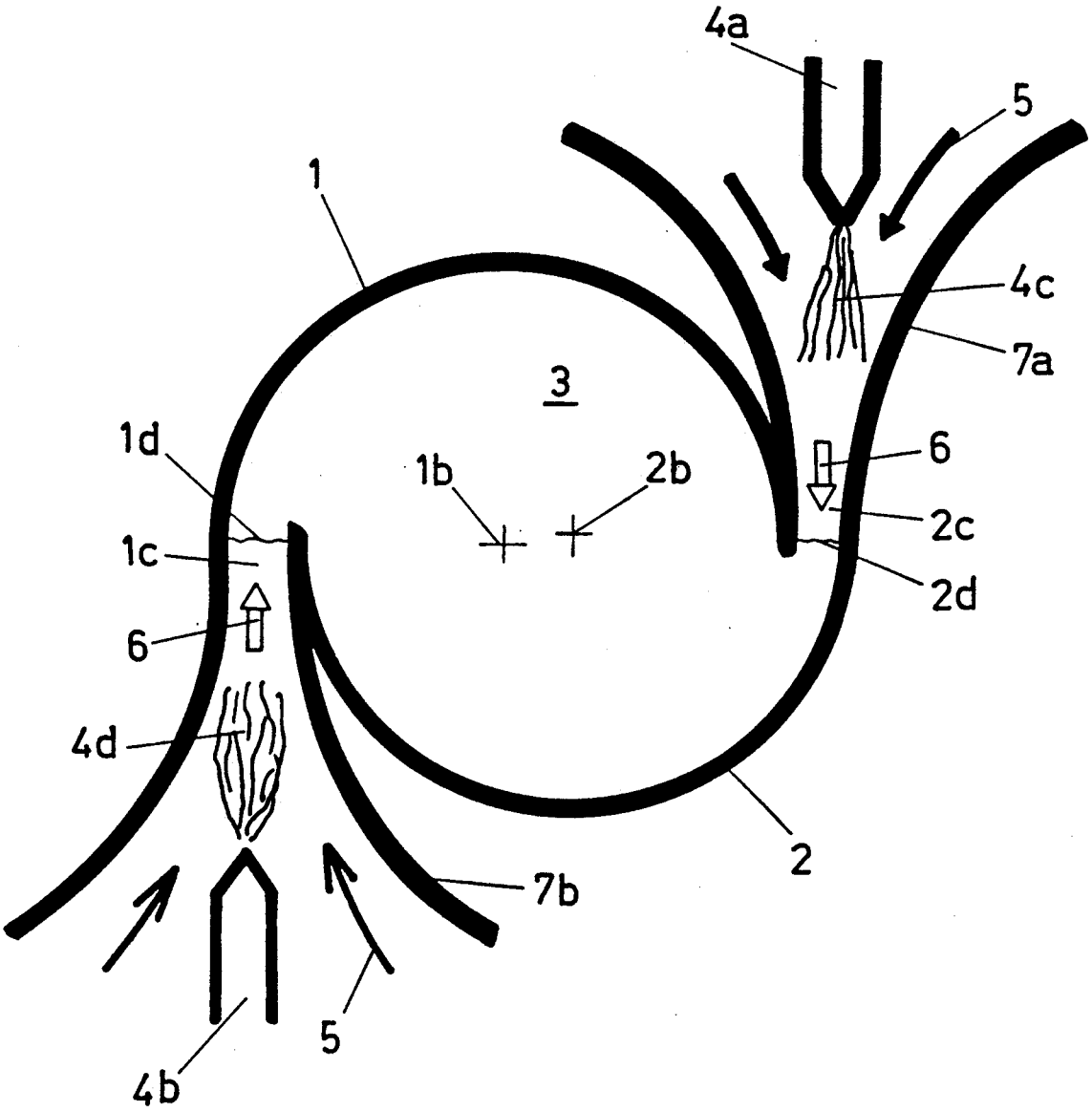
FIG. 2 shows a diagrammatic representation of the air supply in the region of a fuel nozzle, as Section II—II of FIG. 1.

Referring now to the drawings, wherein all the elements not immediately necessary for understanding of the invention are omitted, the flow direction of the media is indicated by arrows and like reference numerals designate identical or corresponding parts in both views, it is advantageous—in order to understand the construction of the burner better to lay out FIG. 1 and FIG. 2 simultaneously when studying the description. Furthermore, in order to make the individual figures easier to understand, partial aspects of the burner are distributed among the individual figures, this fact being indicated in the description of these figures.

The substantially conical core body of the burner shown in FIG. 1 consists of two half hollow partial conical bodies, 1, 2, which are placed offset one above the other. The offset of the respective centrelines produces a free tangential inlet slot 1*c*, 2*c* (FIG. 2) on each of the two sides in axially symmetrical arrangement. An air/fuel mixture 6 flows into the internal space 3 of the burner, i.e. into the conical hollow space, through these inlet slots. Because of the shape of this burner, it is also referred to below as a "double-cone burner" or "BV burner".

The conical shape in the flow direction of the partial conical bodies 1, 2 shown has a certain fixed angle. The partial conical bodies 1, 2 can, of course, describe an increasing conical inclination (convex shape) or a decreasing conical inclination (concave shape) in the flow direction. The two latter shapes are not included in the drawing because they can be envisaged without difficulty.

The shape which is finally used depends on the various parameters of the combustion process. The shape shown in the drawing is preferably used. The tangential inlet slot width is a dimension which results from the offset of the two centrelines (1*b*, 2*b* in FIG. 2) relative to one another.

The two partial conical bodies 1, 2 each have a cylindrical initial part 1*a*, 2*a* which likewise extend, in a manner analogous to the partial conical bodies 1, 2 mentioned, offset relative to one another so that the tangential air inlets 1*c*, 2*c* (FIG. 2) are present over the whole length of the BV burner. The BV burner can, of course, be designed to be purely conical, i.e. without the initial cylindrical part. At the combustion space end 8, the BV burner has a wall 9 which, for example, forms the inlet front of an annular combustion chamber or a firing plant. The air/fuel mixture 6 flowing into the internal space 3 of the BV burner through the tangential air inlets 1*c*, 2*c* (FIG. 2) forms, corresponding to the shape of the BV burner, a conical mixture profile 10 which winds in vortex fashion in the flow direction. In the region where the vortex bursts, i.e. at the end of the BV burner where a reverse flow zone 11 forms, the optimum, homogeneous fuel concentration is achieved over the cross-section, i.e. a very uniform fuel/air mixture is present in the region of the reverse flow zone 11. The ignition itself takes place at the apex of the reverse flow zone 11; it is only at this point that a stable flame front 12 can occur. Burn-back of the flame into the interior of the BV burner (which is always to be feared in the case of known premixed sections and against which help is provided by complicated flame holders) does not have to be feared in the present case because:

Firstly, narrow limits have to be maintained in the design of the partial conical bodies 1, 2 with respect to their cone angle and the width of the tangential air inlets so that the desired flow; field of the mixture 6 forms, for flame stabilization purposes, with its reverse flow zone 11 in the region of the mouth of the burner.

Secondly, because the injection of the fuel and the evaporation of the same is screened from the flame radiation of the flame front 12, as shown diagrammatically and particularly clearly in FIG. 2, there is no interaction between the flame radiation and the fuel droplets so that this again removes the danger of premature ignition of the mixture 6. In the case of evaporation before entry into the combustion zone in the region of the flame front 12, the pollutant emission values are at a minimum.

FIG. 2 is a section through the BV burner along the plane II—II where two fuel nozzles 4*a*, 4*b* are also located. The number and size of the fuel nozzles provided in the flow direction of the BV burner depends on the output which has to be provided by these BV burners. In consequence, the fuel 4*c*, 4*d* is introduced via an arrangement of fuel nozzles 4*a*, 4*b* (which are preferably designed as injection nozzles when a liquid fuel is used) into the inlet ducts 7*a*, 7*b* and there pre-evaporated before actual entry into the internal space 3 of the double-cone burner. The velocity of the combustion air 5 and the distance of the fuel nozzles from the inlet slots 1*d*, 2*d* into the internal space 3 of the burner must be matched to the temperature of the combustion air 5, to the properties of the fuel 4*c*, 4*d* and, in the case of liquid fuel, to the maximum size of the fuel droplets in such a way that the fuel in the mixture 6 is pre-evaporated before reaching the inlet slots 1*d*, 2*d* because from this passage point onwards, the mixture 6 is in "visible contact" with the flame, i.e. with the flame front 12.

It is advantageous if the combustion air 5 is an air/exhaust gas mixture.

This recirculation of a quantity of partially cooled exhaust gas, which originally has a temperature of approximately 950° C., is also necessary for optimum operation of the double-cone burner if the latter is used in atmospheric firing plants with near-stoichiometric operation. The optimum mass flow ratio, i.e. the ratio of the recycled exhaust gas to the added fresh air, is approximately 0.7.

At a fresh air temperature of, for example, 15° C. and an exhaust gas temperature of approximately 950° C., a mixed temperature of approximately 400° C. is achieved for the air/exhaust gas mixture, which is now introduced instead of the combustion air 5. These relationships lead in a double-cone burner with a thermal output of some 100 to 200 kW to optimum evaporation conditions for the liquid fuel and to a minimizing of the NOx/CO/UHC emissions, the danger of flashback because of the interaction between the flame radiation and the fuel droplets being then non-existent.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the U.S. is:

1. A method for premixed combustion of a fuel in a burner having a first partial conical body having a longitudinal centerline and a second partial conical body having a longitudinal centerline, said first and second partial conical bodies being positioned adjacent one another with the respective centerlines thereof in parallel offset relation so as to form a substantially conical core body having two longitudinally extending tangential inlet openings for feeding into an internal space of the core body, said burner further including a duct communicating with each of said inlet openings and at lest one liquid fuel nozzle in each said duct, said method comprising the steps of:

discharging liquid fuel from each of said nozzles; and permitting said fuel to be vaporized in the respective ducts to form a gaseous fuel in the respective ducts, the gaseous fuel entering the internal space of the core body and being discharged and combusted to form a flame fremont at a large diameter end of said core body, wherein said ducts are positioned external to said core body such that said partial conical bodies screen the discharged liquid from radiation feronm the flame front and such that only the evaporated gaseous fuel enters the radiation region of the flame.

2. Method as claimed in claim 1, wherein the evaporation of the fuel is carried out with an air/exhaust gas mixture.

3. Method as claimed in claim 1, wherein the ratio between the recycled exhaust gas and the added air is 0.7.

4. A burner for premixed combustion of a fuel, comprising:

a first partial conical body having a longitudinal centerline;

a second partial conical body having a longitudinal centerline, said fist and second partial conical bodies being positioned adjacent one another with respective centerlines thereof in parallel offset relation so as to form a substantially conical core body having two longitudinally extending tangential inlet openings for feeding into an internal space of the core body;

a duct communicating with each of said inlet openings; and at least one liquid fuel nozzle in each said duct, said nozzles being positioned such that fuel discharged from each of said nozzles is vaporized in the respective ducts to form a gaseous fuel in he respective ducts, the gaseous fuel entering the internal space of the core body and being discharged and combusted to form a flame front at a large diameter end of said core body, wherein said ducts are positioned external to id core body such that said partial conical bodies comprise means for screening the discharged liquid from radiation from the flame front such that only the evaporated gaseous fuel enters the radiation region of the flame.

* * * * *